US005622059A

United States Patent [19]

McClellan

[11] Patent Number: 5,622,059

[45] Date of Patent: Apr. 22, 1997

[54] ICEBOX

[76] Inventor: Robert L. McClellan, 26 Stein Rd., Ellington, Conn. 06029

[21] Appl. No.: 568,784

[22] Filed: Dec. 7, 1995

[51] Int. Cl.[6] ..... F25D 19/02

[52] U.S. Cl. ..... 62/448; 62/298; 312/116; 312/406

[58] Field of Search ..... 62/259.1, 298, 62/440, 448, 457.9; 312/116, 401, 406.2, 406, 407

[56] References Cited

U.S. PATENT DOCUMENTS

| | | | |
|---|---|---|---|
| 3,205,674 | 9/1965 | Arnold et al. | 62/259.1 |
| 4,898,004 | 2/1990 | Richardson | 62/255 |
| 5,086,627 | 2/1992 | Borgen | 62/229 |
| 5,187,945 | 2/1993 | Dixon | 62/234 |
| 5,245,838 | 9/1993 | Cavalea | 62/259.1 |
| 5,284,023 | 2/1994 | Silva et al. | 62/77 |

FOREIGN PATENT DOCUMENTS

| | | | |
|---|---|---|---|
| 2481430 | 10/1981 | France | 62/298 |

*Primary Examiner*—William Doerrler
*Attorney, Agent, or Firm*—Ira S. Dorman

[57] ABSTRACT

A refrigerated icebox employs a cabinet that is internally corrugated to provide a multiplicity of lengthwise channels for air flow within the enclosure defined. The cabinet has a top wall that is provided with an opening to accommodate a drop-in refrigeration unit, and it is, in the main, integrally formed as a single piece.

10 Claims, 4 Drawing Sheets

ICEBOX

BACKGROUND OF THE INVENTION

It is now common practice to merchandise blocks of ice, and ice cubes in bulk packaged form, from free-standing refrigerated cabinets. Presently available systems for doing so are not however of optimal design or construction, from a number of standpoints.

More particularly, it is of course desirable that refrigeration be achieved in any such system in a highly efficient and reliable manner. The cabinet employed must not only contribute to that function but should also be capable of a relatively facile and economic manufacture, and economic transport and ready installation are highly significant commercial factors as well.

SUMMARY OF THE INVENTION

Accordingly, it is the broad object of the present invention to provide a refrigerated cabinet system by which the above-noted deficiencies of existing comparable systems are avoided, or at least improved upon substantially.

It has now been found that the foregoing and related objects of the invention are attained by the provision of a system in which a cold-air refrigeration unit is installed within a cabinet that provides an enclosure, the enclosure being defined by thermal insulating sidewall and bottom wall structures, in cooperation with a top wall structure that substantially spans the sidewall structure and is spaced remotely above the bottom wall structure. A door opening in the sidewall structure provides access to the cabinet enclosure, and is of internally corrugated form to define, between the top and bottom wall structures, a multiplicity of lengthwise channels for free air flow. The refrigeration unit is removably supported upon the top wall structure, and is in operative communication with the enclosure, through an opening provided in the supporting structure, for producing a flow of cold air within the enclosure.

In preferred embodiments, the top wall structure will be spaced downwardly from the upper end of the sidewall structure so as to define an overlying compartment in which the refrigeration unit is contained; the top wall structure may be seated upon a peripheral ledge, integrally formed into the sidewall structure at a level below its upper end. Floor structure will most desirably be disposed above the bottom wall structure, at a level proximate thereto and substantially spanning the sidewall structure, such that the lengthwise sidewall channels extend below the floor structure; underlying support may be provided by a multiplicity of mutually spaced, upstanding leg elements that are integrally formed on the bottom wall structure and permit free air flow beneath the floor structure.

In especially preferred embodiments, the sidewall and bottom wall structures of the cabinet will be integrally formed with one another, as a single piece. The several insulating wall structures will advantageously comprise a core of thermally insulating synthetic resinous material (normally of cellular form), between surface layers of a tough synthetic resinous moisture- and vapor-barrier material. At least one ferromagnetic element may be provided on the sidewall structure adjacent the door opening, in which case the door will have a cooperating magnetic element for holding it in closed position.

DETAILED DESCRIPTION OF THE PREFERRED AND ILLUSTRATED EMBODIMENT

Figure 1:
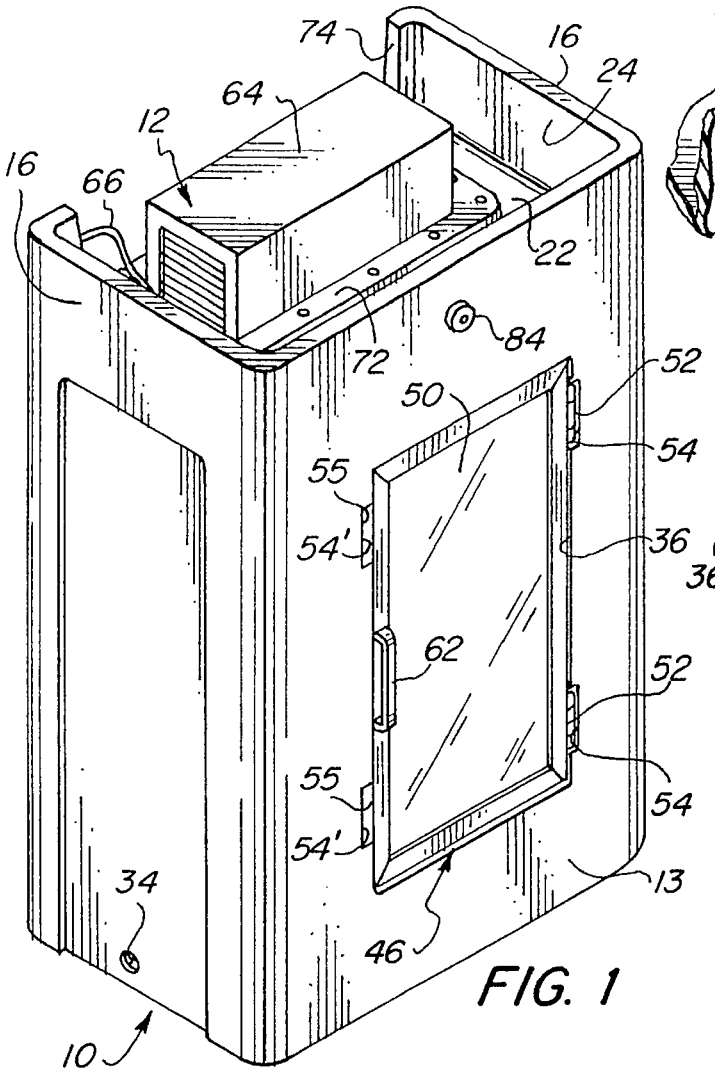
FIG. 1 is a perspective view of a refrigerated cabinet system, or icebox, embodying the present invention.
Figure 2:
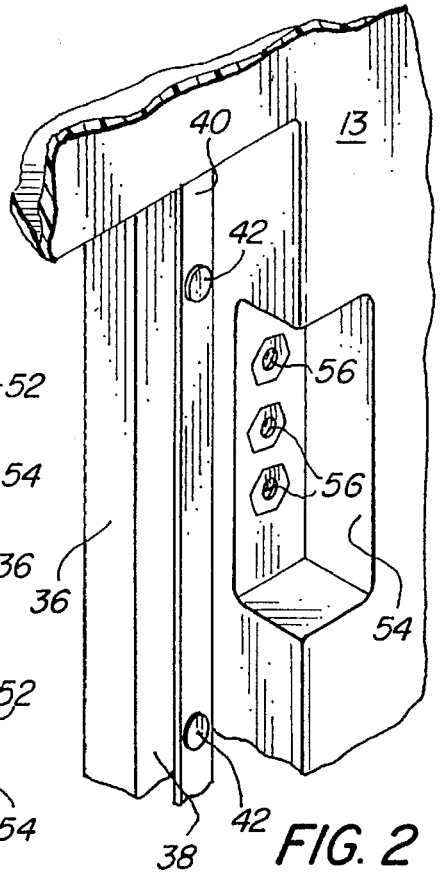
FIG. 2 is a fragmentary perspective view showing a hinge area of the cabinet employed in the system of FIG. 1, drawn to a greatly enlarge scale.
Figure 3:
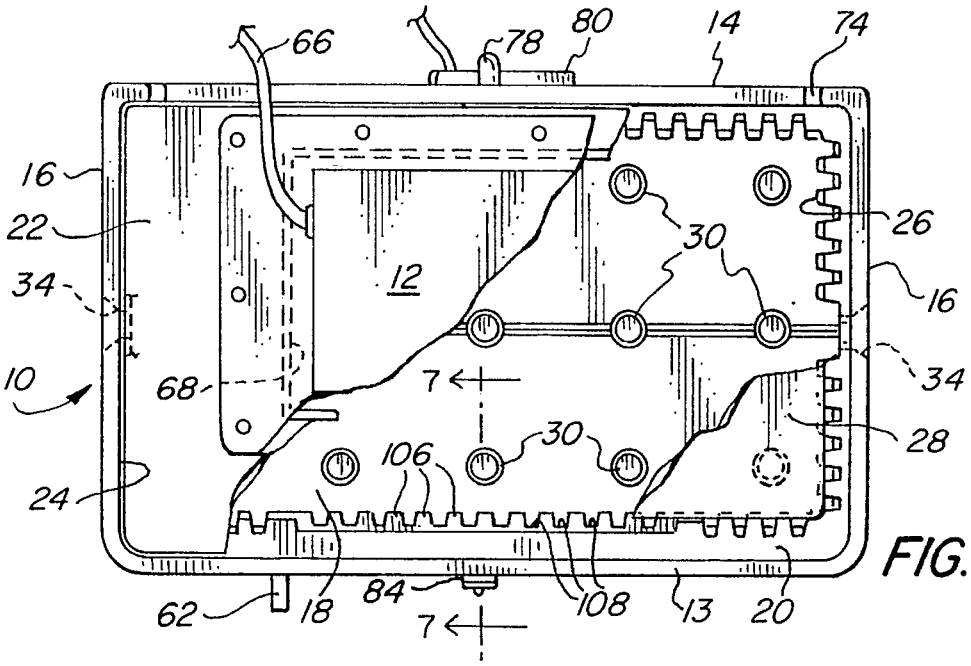
FIG. 3 is a plan view Of the system of FIG. 1, with portions broken away to expose underlying components and features.
Figure 4:
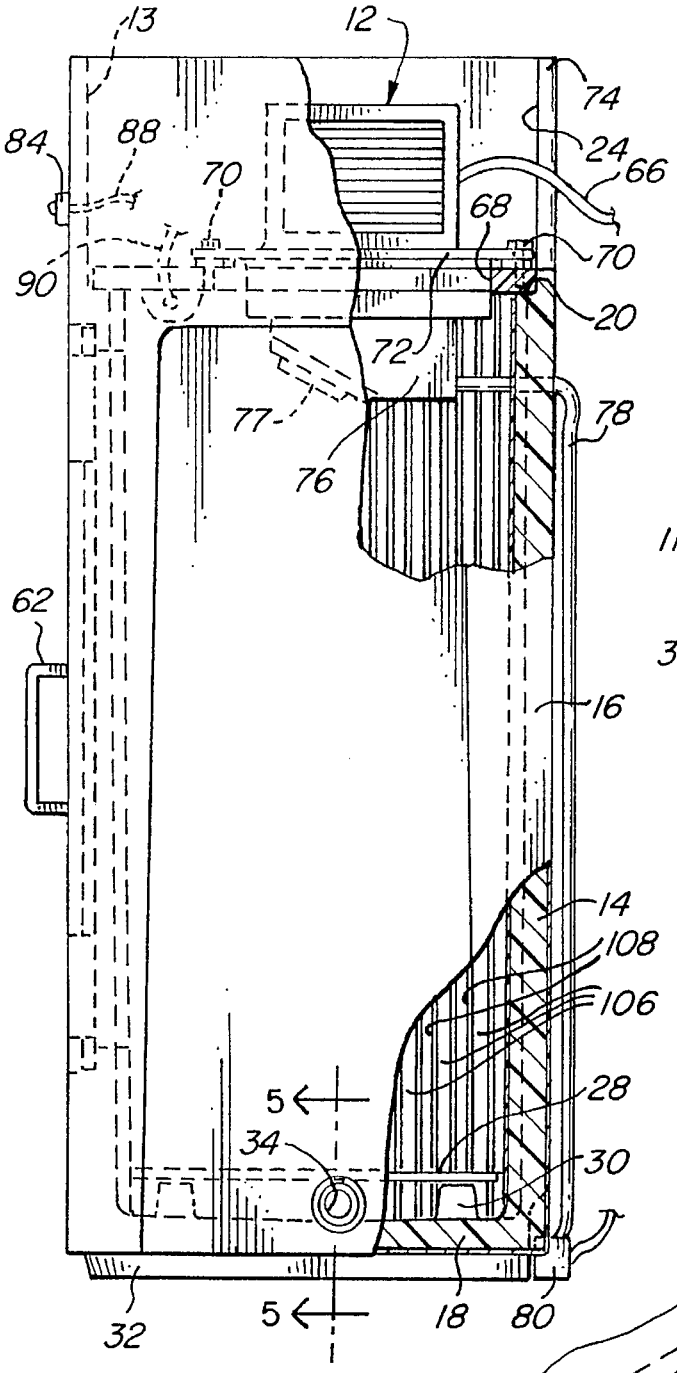
FIG. 4 is a side elevational view of the system of FIG. 1, with portions broken away to expose internal components and features.
Figure 5:
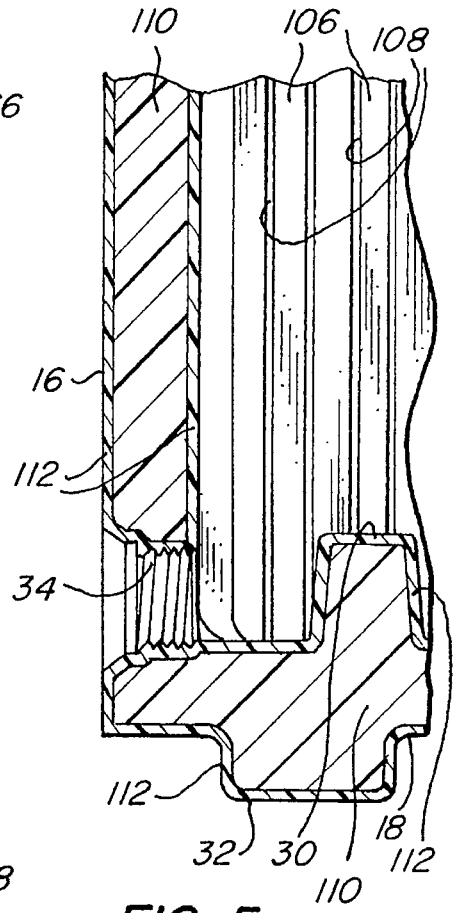
FIG. 5 is a fragmentary sectional view of the cabinet of the illustrated system, taken along line 5—5 and drawn to an enlarged scale.
Figure 6:
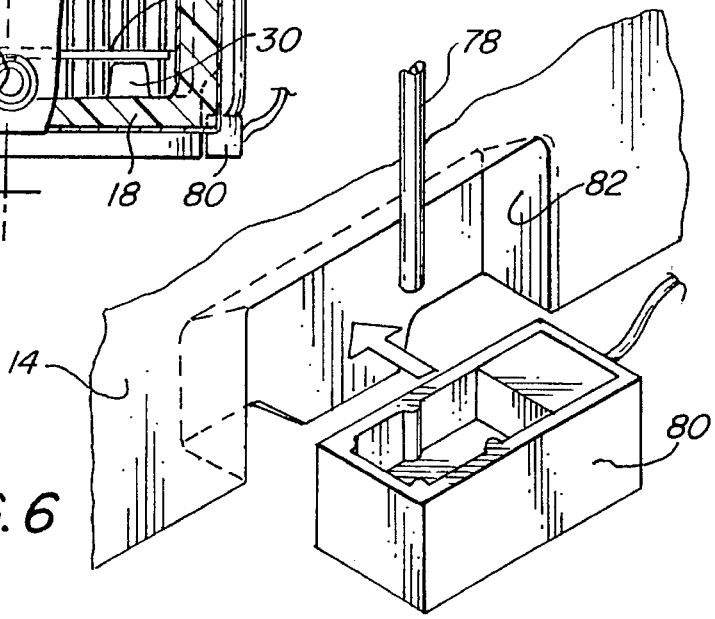
FIG. 6 is a fragmentary perspective view of a central bottom section of the rear wall of the cabinet showing, in a displaced position, an evaporation unit that is normally assembled therewith.
Figure 7:
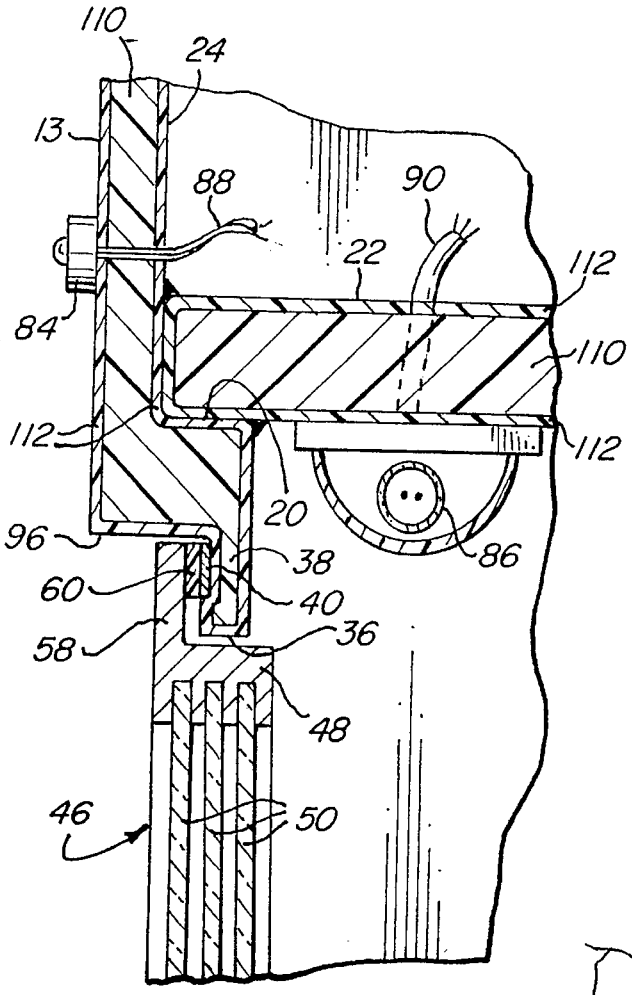
FIG. 7 is a fragmentary sectional view of an upper forward portion of the system of the invention, taken along line 7—7 of FIG. 3.
Figure 8:
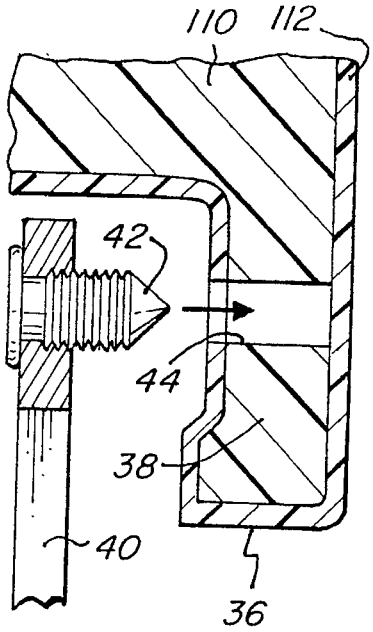
FIG. 8 is a fragmentary sectional view showing details of the jamb assembly of the illustrated cabinet.

The icebox illustrated in the appended drawings consists essentially of a cabinet, generally designated by the numeral 10, and a refrigeration unit, generally designated by the numeral 12. The cabinet 10 includes a front wall 13, a rear wall 14, two opposite side walls 16, and a bottom wall 18, all of which are integrally formed as a single piece. The walls 13, 14 and 16 cooperatively provide a continuous ledge 20 extending peripherally about the cabinet 10, near its upper end, on which is seated a top wall 22; the wall 22 divides the cabinet into an upper compartment 24 and a main enclosure 26 therebelow.

Figure 11:
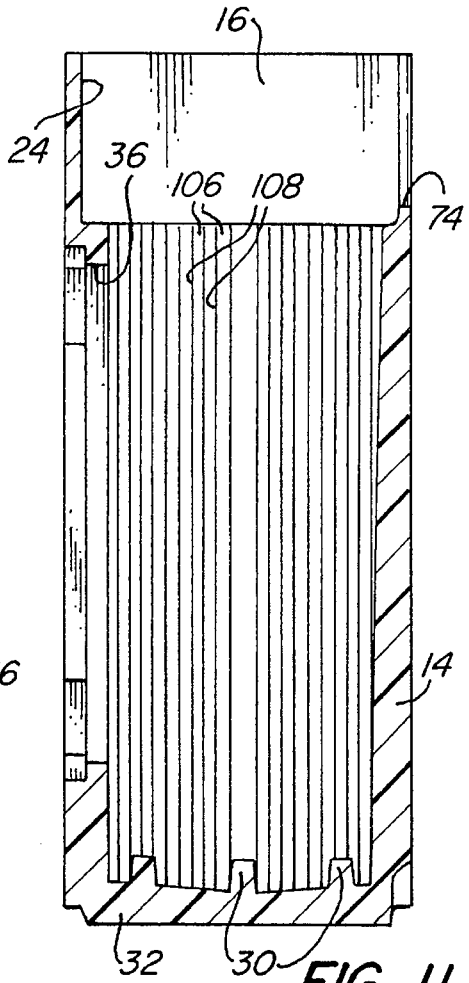
FIG. 11 is a view similar to FIG. 10, taken on a transversely extending plane through the cabinet.
Figure 12:
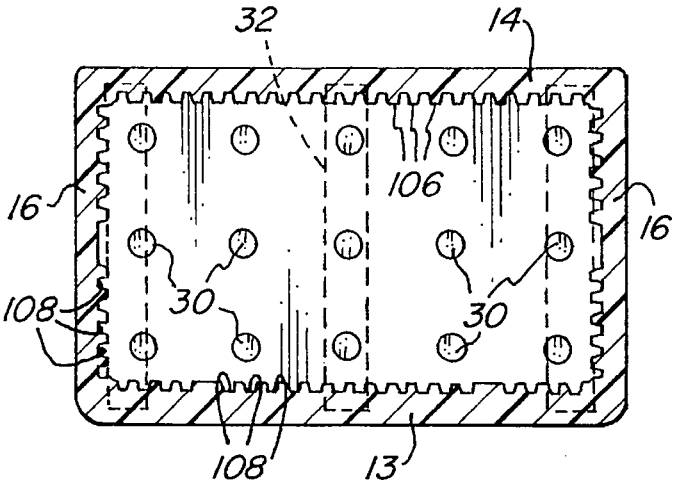
FIG. 12 is a horizontal sectional view of the cabinet.

A false floor 28 spans the enclosure 26, and is supported upon an array of short, upstanding legs 30 integrally formed on the bottom wall 18; three runners 32, extending from front to rear, are similarly formed externally on the bottom wall. As is best seen in FIG. 11, the inner surface of the bottom wall 18 slopes (as viewed in transverse planes) towards the center of the cabinet, at which location a pair of threaded drain openings 34 are provided adjacent the bottom of each sidewall 16.

The front wall 13 of the cabinet is formed with a rectangular door opening 36, bordered by a relatively narrow marginal flange portion 38. A rectangular frame 40, fabricated from a ferromagnetic material (normally steel), is attached to the flange portion 38 so as to extend entirely about the door opening 36; mounting is effected by use of ribbed plastic fasteners 42, forced into flange apertures 44.

A door, generally designated by the numeral 46, consists of a metal frame 48 in which are mounted three glass panes 50; an all-metal, or other door construction, may however be employed if preferred. Hinge assemblies 52 are provided along one edge of the door frame 48, the stationary parts of which are seated within recesses 54 formed into the jamb section of the front wall 13; threaded bushings 56 are molded in place to open within the recesses 54, and serve to receive screws by which the door frame hinge parts are attached. It will be noted that two corresponding openings 54' are provided on the other side of the jamb, to thereby permit mounting of a door to open in the opposite direction; inserts 55 are secured within the two unused recesses 54'. Although not illustrated, it might be noted that vertical reinforcing bars, to which the bushings 56 would be attached, may be molded into the jamb section to extend between the two recesses 54 on each side; the bars would serve to distribute the weight of the door, and thereby to minimize sagging.

The door frame 48 has a peripheral flange 58, to which is secured a surrounding gasket 60. The gasket 60 is fabricated from a resilient natural or Synthetic resinous material containing a dispersed particulate magnetic filler, and serves not only for sealing purposes but also to cooperate with the metal frame 40 for maintaining the door in closed position.

The cold-air refrigeration unit 12 includes a housing 64 and an electric power cable 66; the upper portion of the back wall 14 of the cabinet 10 is indented at 74 so as to facilitate on-site placement of the refrigeration unit 12 within the chamber 24. The peripheral flange portion 72 of the housing 64 rests upon the marginal portion surrounding the top wall opening 68, and fasteners 70 secure the unit 12 in place. A lower portion 76 of the housing 64 extends through the opening 68 of the wall 22, and is disposed within the enclosure 26. It has an air flow port 77, through which refrigerated air is discharged into the enclosure, and is fitted with a drainage hose 78. The hose 78 extends through the back wall 16, to a point just above the well of an electric vaporization unit 80 (which is normally seated within the recess 82 in the lower portion of the wall 14); such units are of standard design, and are provided with heating means to effect evaporation of liquids delivered thereto, as through the hose 78.

A fluorescent lighting Unit is mounted upon the underside of the top wall 22, and includes a tubular bulb 86 for illuminating the contents of the enclosure 26. The small lamp unit 84, mounted on the front wall 13 of the cabinet, serves to indicate that the refrigeration unit is in operation; electrical connections for the lamp and bulb 84 and 86 are made through the cables 88 and 90, respectively.

Figure 9:
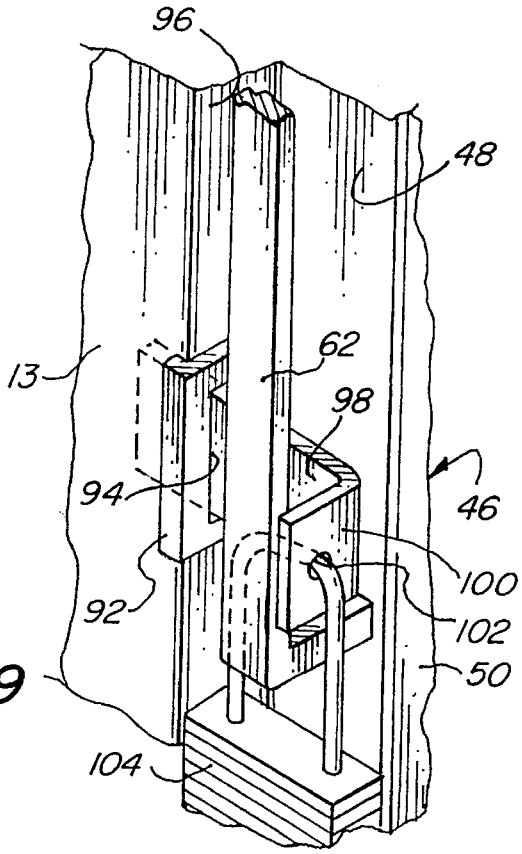
FIG. 9 is a fragmentary perspective view showing a locking arrangement that may be incorporated into the system.
Figure 10:
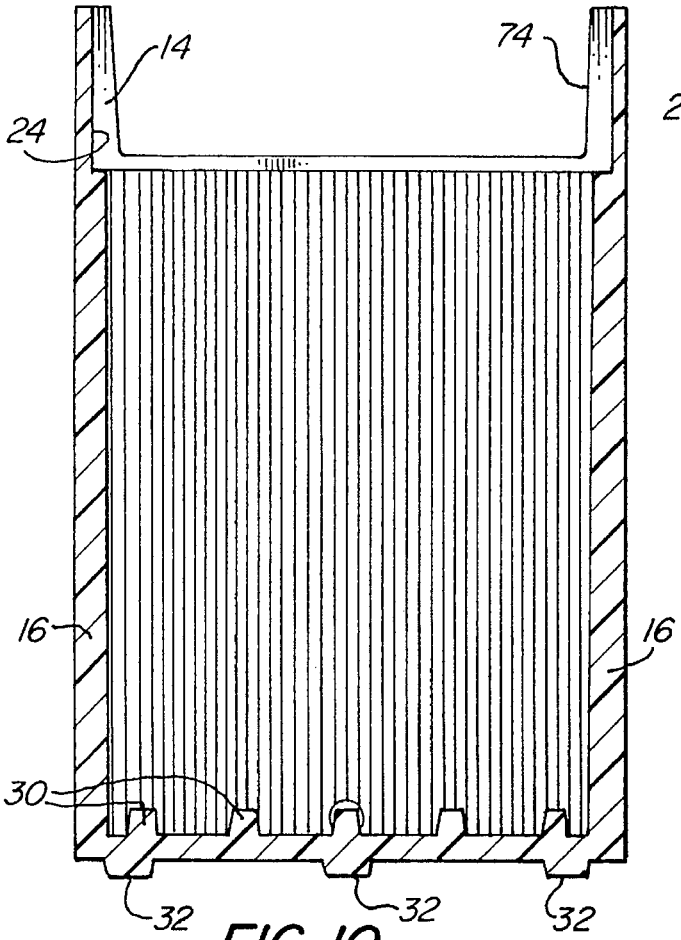
FIG. 10 is a vertical sectional view taken on a laterally extending plane through the cabinet.

As seen in FIG. 9, a metal face plate 92, formed with a slot opening 94, is secured against the narrow edge surface 96 comprising the door jamb. The longer leg 98 of an L-shaped latch piece extends through the door handle 62 and the slot opening 94, and into the jamb structure of the wall 13; the shorter leg 100 is formed with an aperture 102, and receives the bail of a padlock 104. As will be appreciated, this arrangement may be used to secure the door 46 against unauthorized access to the cabinet enclosure.

Figure 13:
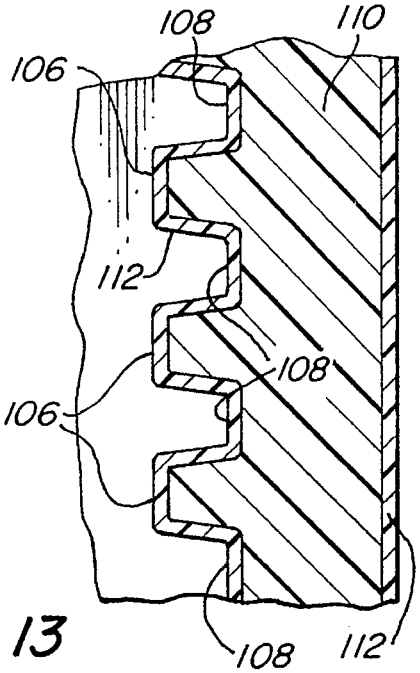
FIG. 13 is a fragmentary sectional view, drawn to an enlarged scale, showing wall construction details.

The corrugated interior wall structure is illustrated in greatest detail in FIG. 13 of the drawings, and can be seen to consist of a series of ribs 106 and intervening channels 108. The channels 108 extend lengthwise between the top wall 22 and the bottom wall 18, and serve to permit free air flow within the enclosure. This enables ready circulation of cold air, passing from the refrigeration unit to the bottom of the cabinet and under the false floor 28, thereby affording highly effective and efficient refrigeration of the contents of the icebox.

As is also best seen in FIG. 13, the cabinet walls comprise a core 110 of synthetic resinous material (normally of a rigid foam material, such as polyurethane), disposed between skin layers 112 fabricated from a tough gas- and liquid-impermeable synthetic resinous material, such as high-density polyethylene. This construction, and integral formation of the several walls of the cabinet, can be achieved by use of spin-molding techniques. It will be appreciated that the cabinet need not have the particular configuration or construction illustrated, and that references herein to "sidewalls" should be understood to include forward and rearward walls or wall portions, as the context may imply.

Thus, it can be seen that the present invention provides a system for storing and dispensing ice, in which refrigeration is achieved in a highly efficient and reliable manner. The cabinet employed contributes to the efficiency of refrigeration, and is itself capable of relatively facile and inexpensive manufacture. Moreover, the components of the system can be shipped in unassembled condition, in turn permitting the cabinets to be transported in recumbent positions, and on-site installation is relatively fast and easy; these features afford significant commercial benefit.

Having thus described the invention, what is claim is:

1. A refrigerated cabinet system, comprising:

a cabinet providing an enclosure defined by thermal insulating sidewall and bottom wall structures integrally formed as a single piece and having surfaces of a synthetic resinous material, and by top wall structure substantially spanning said sidewall structure and disposed above said bottom wall structure at a level remote therefrom, said top wall structure also having surfaces of synthetic resinous material and lying in direct surface contact with said surfaces of said sidewall structure, said sidewall structure having a door opening providing access to said enclosure, and said top wall structure having an opening therethrough and being adapted to support a refrigeration unit thereupon; and an integral cold-air refrigeration unit removably supported upon said top wall structure and extending through said top wall structure opening into operative communication with said enclosure, for producing a flow of cold air therewithin.

2. The system of claim 1 wherein said top wall structure is spaced downwardly from the upper end of said sidewall structure to define, with said sidewall structure, a compartment above said enclosure in which said refrigeration unit is contained.

3. The system of claim 1 wherein said sidewall structure has a peripheral ledge integrally formed thereinto at a level below the upper end of said sidewall structure, said top wall structure being seated in direct surface contact upon said ledge.

4. The system of claim 1 wherein said cabinet additionally includes floor structure disposed above said bottom wall structure at a level proximate thereto and substantially spanning said sidewall structure, said lengthwise channels of said sidewall structure extending to a level below said floor structure.

5. The system of claim 4 wherein said bottom wall structure of said cabinet has a multiplicity of mutually spaced, upstanding leg elements integrally formed thereon to provide underlying support for said floor structure and to permit free air flow therebeneath.

6. The system of claim 1 wherein said bottom wall structure of said cabinet is formed with an upper surface portion that lies at an incline when said cabinet is operatively supported on a horizontal surface, and wherein said sidewall structure has at least one drain opening therethrough adjacent a low point on said upper surface portion.

7. The system of claim 1 wherein said sidewall and bottom wall structures comprise a core of thermally insulating synthetic resinous material between surface layers of a synthetic resinous barrier material.

8. The system of claim 1 wherein said cabinet is of generally rectangular cross section, taken in both horizontal and vertical planes.

9. The system of claim 1 wherein said cabinet additionally includes a door hingedly mounted on said sidewall structure to span said door opening, and wherein at least one ferromagnetic element is provided on said sidewall structure adjacent said door opening, said door having a magnetic element thereon disposed to cooperate with said ferromagnetic element for disengageably maintaining said door in closed position over said opening.

10. A refrigerated cabinet system, comprising:

a cabinet providing an enclosure defined by thermal insulating sidewall and bottom wall structures integrally formed as a single piece and having surfaces of a synthetic resinous material, and by top wall structure substantially spanning said sidewall structure and disposed above said bottom wall structure at a level remote therefrom, said sidewall structure having a door opening providing access to said enclosure, and being of internally corrugated form to provide a multiplicity of lengthwise channels for free air flow within said enclosure between said top and bottom wall structures, said top wall structure having an opening therethrough and being adapted to support a refrigeration unit thereupon; and a cold-air refrigeration unit removably supported upon said top wall structure, said refrigeration unit being in operative communication with said enclosure, through said top wall structure opening, for producing a flow of cold air within said enclosure, said bottom wall structure of said cabinet being formed with an upper surface portion that lies at an incline when said cabinet is operatively supported on a horizontal surface, and said sidewall structure having at least one drain opening therethrough adjacent a low point on said upper surface portion.

* * * * *